US009506421B2

(12) United States Patent
Edmo

(10) Patent No.: US 9,506,421 B2
(45) Date of Patent: Nov. 29, 2016

(54) CYLINDER LINER AND CAST IRON ALLOY

(75) Inventor: Soares J. Edmo, Jundiaí (BR)

(73) Assignees: MAHLE Metal Leve S.A., Jundiai (BR); MAHLE International GmbH, Stuttgart (DE)

( * ) Notice: Subject to any disclaimer, the term of this patent is extended or adjusted under 35 U.S.C. 154(b) by 361 days.

(21) Appl. No.: 14/239,240

(22) PCT Filed: Aug. 17, 2012

(86) PCT No.: PCT/BR2012/000391

§ 371 (c)(1),
(2), (4) Date: May 21, 2014

(87) PCT Pub. No.: WO2013/026124

PCT Pub. Date: Feb. 28, 2013

(65) Prior Publication Data

US 2014/0318516 A1 Oct. 30, 2014

(30) Foreign Application Priority Data

Aug. 17, 2011 (BR) ..... 1103921

(51) Int. Cl.

| | |
|---|---|
| ***C22C 37/04*** | (2006.01) |
| ***C22C 37/10*** | (2006.01) |
| ***F02F 1/00*** | (2006.01) |
| ***C22C 33/08*** | (2006.01) |

(52) U.S. Cl.

CPC ..... *F02F 1/004* (2013.01); *C22C 33/08* (2013.01); *C22C 37/04* (2013.01); *C22C 37/10* (2013.01)

(58) Field of Classification Search
None
See application file for complete search history.

(56) References Cited

U.S. PATENT DOCUMENTS

| | | | |
|---|---|---|---|
| 4,017,708 | A | 4/1977 | Engel et al. |
| 2008/0314353 | A1 | 12/2008 | Highum |

FOREIGN PATENT DOCUMENTS

| | | | | |
|---|---|---|---|---|
| DE | 3327490 | A1 | | 2/1984 |
| JP | 360021355 | A | * | 2/1985 |
| WO | WO-2006/022494 | A1 | | 3/2006 |
| WO | WO-2006/072663 | A2 | | 7/2006 |

OTHER PUBLICATIONS

Machine-English translation of Japanese publication No. 07-14544, Kato Shoji, Nov. 24, 1993.*
Machine-English translation of DE 004438073 A1, Buenning, Frithjof, May 2, 1996.*
English abstract provided for DE-3327490.

* cited by examiner

*Primary Examiner* — Deborah Yee
(74) *Attorney, Agent, or Firm* — Alston & Bird LLP

(57) ABSTRACT

A cylinder liner for an internal combustion engine may include a cast iron alloy having a pearlitic structure with at least 70% of graphitization with spheroidal graphite morphology. The cast iron alloy may include at least 2.8% to 4.0% in weight of carbon; 1.8% to 3.5% in weight of silicon; 0.2% to 1.0% in weight of manganese; a maximum of 0.5% in weight of phosphorus; a maximum of 0.05% in weight of sulfur; a maximum of 0.5% in weight of vanadium; a maximum of 0.5% in weight of molybdenum; 0.2% to 1.5% in weight of nickel; a maximum of 0.3% in weight of tin; 0.005% to 0.06% in weight of magnesium.

16 Claims, 2 Drawing Sheets

CYLINDER LINER AND CAST IRON ALLOY

CROSS REFERENCE TO RELATED APPLICATIONS

This application is a US National Phase Application of PCT/BR2012/000391, filed on Aug. 17, 2012, which claims priority to Brazilian Patent Application No. PI1103921-3, filed on Aug. 17, 2011, the contents of which are both hereby incorporated by reference in their entirety.

TECHNICAL FIELD

This invention refers to a spheroidal graphite cast iron alloy for application to components of an internal combustion engine, more concretely to cylinder liners whose mechanical properties happen to be advantageous in light of the state of the art, allowing at the same time for increasing the power of engines and reducing their weight.

BACKGROUND

Cylinder liners applied to internal combustion engines are engine components which undergo significant wear due to the type of work they perform.

In view of the new demands of the market, the internal components of new engines have higher requirements and, in this regard, need to provide solutions capable of ensuring better performance and also of contributing for more reliability and higher engine output.

Based on this principle, several manufacturers of automotive components search for several technical solutions, particularly for cylinder liners of internal combustion engines, among others.

SUMMARY

One of the possible solutions which enables to improve engine performance may be achieved by enhancing the material used to produce cylinder liners. In this regard, some advancements are proposed, particularly in those cylinder liners comprised by cast iron alloys.

One of the main alloys applied to the production of cylinder liners of the state of the art is the gray cast iron. Such alloy has low cost and offers good machinability due to the presence of free graphite in its microstructure. Anyway, the morphology of gray cast iron shows (llamelar) graphitization in veins distributed in a pearlitic microstructure that ends up impairing important mechanical properties, such as tensile strength, stiffness and fatigue strength.

Such reality results from the presence of graphite in the form of veins dispersed in mesh in a pearlitic microstructure matrix, of random distribution, which results in an amount of interconnected gaps added to a possible propagation of cracks in the material in view of the grooving effect due to the graphite morphology. In other words, cylinder liners comprised by gray cast iron do not have the feature of plastic deformation.

At the attempt of improving the properties of the materials applied to the production of cylinder liners, alloys have been proposed in order to minimize the drawbacks of gray cast iron alloys. For such purpose, solutions containing compacted graphite pearlitic cast iron alloys have been proposed, resulting in better properties when compared to the conventional lamellar pearlitic material.

In this regard, patent document PI9704066-5 describes a cast iron alloy for the production of piston rings of internal combustion machines where a cast iron alloy highly resistant to heating is disclosed. Such alloy comprises a predominantly pearlitic basic structure having graphite precipitations in compacted and spheroidal graphite forms. Although the document quickly mentions other possible applications, pointing out as hypothesis the application to cylinder liners, it does not goes further into the topic, opening room for possible applications of different cast iron alloys to several engine parts.

Please note that the specialized literature identifies a typical limit of 30% of spheroidal graphite in an material intended with compacted graphite. Therefore, it is common that a material considered as compacted graphite cast iron alloy has a percentage of spheroidal graphite (see FIG. 1).

Yet, even a cast iron alloy whose graphite has a morphology combined of compacted and spheroidal graphite is not sufficient to ensure excellent performance in cylinder liners, in addition to the fact that the cost of a cylinder liner in the solution presented in patent document PI9704066-5, for instance, has drawbacks in the matter of feasibility in industrial scale of production.

In addition, U.S. Pat. No. 6,318,330 describes a cylinder liner of dual phase graphite morphology wherein the outer diameter is comprised of spheroidal graphite and compacted graphite iron and the inner diameter is comprised of predominantly gray iron or flake iron. The advantages of this patent is that the outer diameter of ductile iron is quite strong and resistant to fatigue, cracking and breaking. The inner diameter exhibits good wear and scuff resistance.

However, the dual-phase material shows obstacles for manufacturing, mainly when it comes to the control of distribution of the graphite morphology between the inner and outer diameter of the liner, which may significantly impact the production costs. The patent mentions as method for controlling this morphology distribution from spheroidal-compacted graphite to flake graphite the control of Mg (magnesium) and S (sulfur) contents added to the alloy in view of their deleterious effects for formation of one type or another to ensure the gradual transition of morphology along the cross-section of the liner wall. The interval of the contents to be controlled is within very rigorous ranges, sometimes residual ones, increasing the difficulty level of manufacturing so as to practically make it unfeasible the maintenance of the material according to the description of the rules and respectively in the quality control.

For example, the level of Mg present may have significant effects on graphite morphology. A concentration lower than 0.008% of Mg results in a flake graphite, predominantly lamellar in structure. A concentration of 0.008% to 0.013% of Mg results in compacted CGI graphite, compacted in structure. Furthermore, a concentration of 0.013% to 0.020% of Mg results in a mix of compacted and spheroidal graphite of a compacted and spheroidal nature. In addition, a concentration of 0.020% to 0.035% of Mg results in a 80% to 100% spheroidal graphite structure, whereas Mg concentrations above 0.035% are fully spheroidal.

Similarly, the S levels must be between 0.015% to 0.02% since concentrations above this value will result in the degeneration of spheroidal graphite structure to a lamellar state.

In view of these documents and the state of the art, it is therefore necessary to present an alloy that enables to achieve a graphite morphology at the level that avoids the state of the art problems, offering a solution for cylinder liners with excellent mechanical properties.

Thus, it is important to note that there is not yet a technological solution for cylinder liners which allows for a better mechanical property which results in the possibility of reducing the thickness of their walls and increasing cavitation and corrosion resistance.

Therefore, this invention aims at providing a cylinder liner comprised by an alloy capable of improving its mechanical properties in order to achieve higher efficiency of the engine with longer durability.

Another purpose of this invention is to propose a cylinder liner capable of providing a combustion engine with higher performance, as well as a reduction of its final weight.

Finally, it is also a goal to propose a cast iron alloy having graphitization in nodules capable of providing the elements of an engine with the characteristics defined above.

The purposes of the invention herein are achieved through the supply of a cylinder liner for application to an internal combustion engine, where the liner is comprised by a cast iron alloy having a pearlitic structure with at least 70% of graphitization with spheroidal graphite morphology, whereas the cylinder liner comprises fatigue strength superior to 230 Megapascal (MPa).

The purposes of this invention are also achieved through the supply of a cast iron alloy for the production of components of an internal combustion engine, which alloy has a pearlitic structure with at least 70% of spheroidal graphitization, the cast iron alloy having at least 2.8% to 4.0% in weight of carbon; 1.8% to 3.5% in weight of silicon; 0.2% to 1.0% in weight of manganese; a maximum of 0.5% in weight of phosphorus; a maximum of 0.05% in weight of sulfur; a maximum of 0.5% in weight of vanadium; a maximum of 0.5% in weight of molybdenum; 0.2% to 1.5% in weight of nickel; a maximum of 0.3% in weight of tin; 0.005% to 0.06% in weight of magnesium and iron as remainder.

BRIEF DESCRIPTION OF THE DRAWINGS

This invention will be described next in further details based on examples of execution represented in the drawings. The figures show.

DETAILED DESCRIPTION

Figure 1:
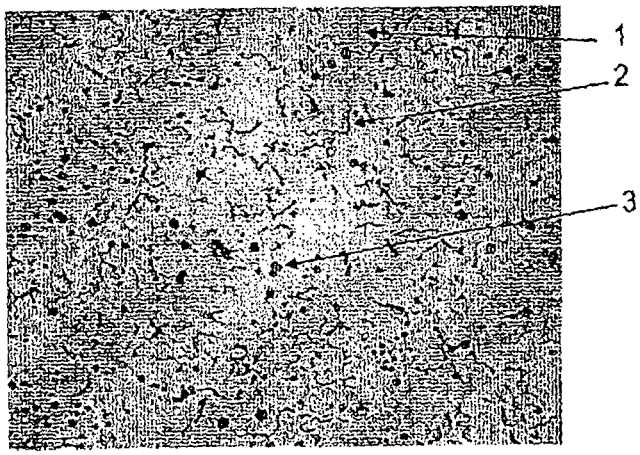
FIG. 1—is a micrography of a cast iron alloy of the state of the art.

This invention proposes a spheroidal graphite cast iron alloy, as well as a cylinder liner produced with this alloy. Such alloy mainly presents a graphite morphology which is predominantly spheroidal graphite. In other words, in an iron matrix 1 the so-called graphitization with spheroidal graphite morphology shall prevail 3, there being a residual value (not higher than 30%) of graphite with morphology in veins 2 (see FIG. 1). Thus, the spheroidal graphite morphology will vary from 70% to 100% as exemplified by FIG. 1.

Figure 2:
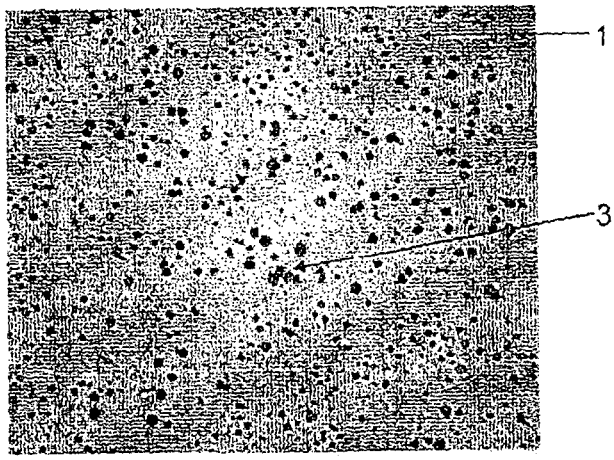
FIG. 2—is a micrography of a cast iron alloy of the present invention.

With the goal of avoiding the formation of graphite in the form of veins knowing that a raise in the amount of magnesium fosters the reduction thereof, a pearlitic cast iron alloy with excellent applicability in cylinder liners was conceived. According to FIG. 2, the cast iron alloy 1 has a graphite morphology which is predominantly spheroidal 2, without the existence of a residual value of graphite with morphology in veins 3.

Such cast iron alloy presents at least 70% of spheroidal graphitization 3 and contains at least 2.8% to 4.0% in weight of carbon; 1.8% to 3.5% in weight of silicon; 0.2% to 1.0% in weight of manganese; a maximum of 0.5% in weight of phosphorus; a maximum of 0.05% in weight of sulfur; a maximum of 0.5% in weight of vanadium; a maximum of 0.5% in weight of molybdenum; 0.2% to 1.5% in weight of nickel; a maximum of 0.3% in weight of tin; 0.005% to 0.06% in weight of magnesium and iron as remainder.

Additionally, the alloy of this invention contains at least one among the elements copper, cobalt, titanium, niobium, boron, aluminum, molybdenum, zirconium, nitrogen, antimony, arsenic and bismuth in a total of up to 7.0% in weight of the alloy total. Furthermore, the cast iron alloy may include up to 15% in weight of ferrite.

Please note that the present spheroidal graphite cast iron alloy may vary the chemical elements among the presented values, as long as it presents a morphology higher than 70% of spheroidal graphite 3, being possible to achieve the maximum amount of 100%.

The spheroidal graphite cast iron alloy of this invention was especially developed for cylinder liners of internal combustion engines, thus ensuring that the main characteristics of this type of alloy be intrinsic to cylinder liners.

Several advantages of this type of alloy arise from the fact that the graphite remains free in the metallic matrix, however in spheroidal graphite form. This shape of graphite provides a greater elasticity modulus of the material, conferring characteristics close to conventional steel in this aspect.

Although its cost is slightly higher when compared to gray cast iron, which has graphite in the form of veins, the improvement of the level of mechanical properties in the cylinder liners perfectly make up for such difference.

Thus, the alloy of this invention, when compared to the state of the art alloys, allows for offering cylinder liners having more mechanical resistance in general, and good resistance to corrosion due to the condition of existing discontinuous graphite in spheroidal form.

Thus, when compared to the state of the art alloys, the alloy of this invention presents very superior typical values which can be translated by the table below.

TABLE 1

Comparison among the results obtained for the different types of cast iron alloys

| Property | Gray cast iron | Difference | Cast iron graphite in veins | Difference | Spheroidal graphite cast iron |
|---|---|---|---|---|---|
| Tensile Strength (MPa) | 235 | 113% | 500 | 30% | 650 |
| Elasticity Modulus (GPa) | 110 | 27% | 140 | 18% | 165 |
| Fatigue Strength (MPa) | 100 | 105% | 205 | 29% | 265 |
| Thermal Conductivity W/(mK) | 48 | −27% | 35 | −20% | 28 |
| Hardness (Hv) | 208 | 13% | 240 | 20% | 286 |
| Yield Strength (0.2%) | 160 | 138% | 380 | 12% | 425 |

As evidenced by the table above, the alloy of this invention allows for achieving cylinder liners whose mechanical properties are clearly superior to the cast iron alloys of the state of the art.

Please note that the only characteristic that did not show expressive improvement is thermal conductivity. Anyhow, although less capable of dissipating the heat generated in the engine combustion, such data must be analyzed in light of the other characteristics. In this regard, it is important to note that the cylinder liner of this invention has the additional characteristic of being easy to reduce the thickness of its wall. Such reduction, which may vary from 3% and 35%, certainly neutralizes the possible disadvantage of the material of this invention regarding the item thermal conductivity in light of the state of the art.

Additionally, the cylinder liner may undergo thermal treatment, such as annealing or equivalent thereof after at least two steps of machining, followed by a new thermal treatment, such as normalization or equivalent thereof, after at least three steps of machining Such thermal treatments and machining processes seek to improve machinability, removing residual stresses from the surface and standardizing the microstructure of the material to extract great mechanical properties.

The cylinder liner of the present invention may optionally be also induction hardened to achieve a Vickers hardness of between 300 HV to 835 HV on inner diameter. Without undergoing this induction hardening, the liner of the present invention has a Vickers hardness of approximately 286 HV. In one possible embodiment, the induction hardening causes the martensitic transformation of up to 1.5 mm of the liner, which may lead to a transformation in hardness from 300 HV to 835 HV.

Figure 3:
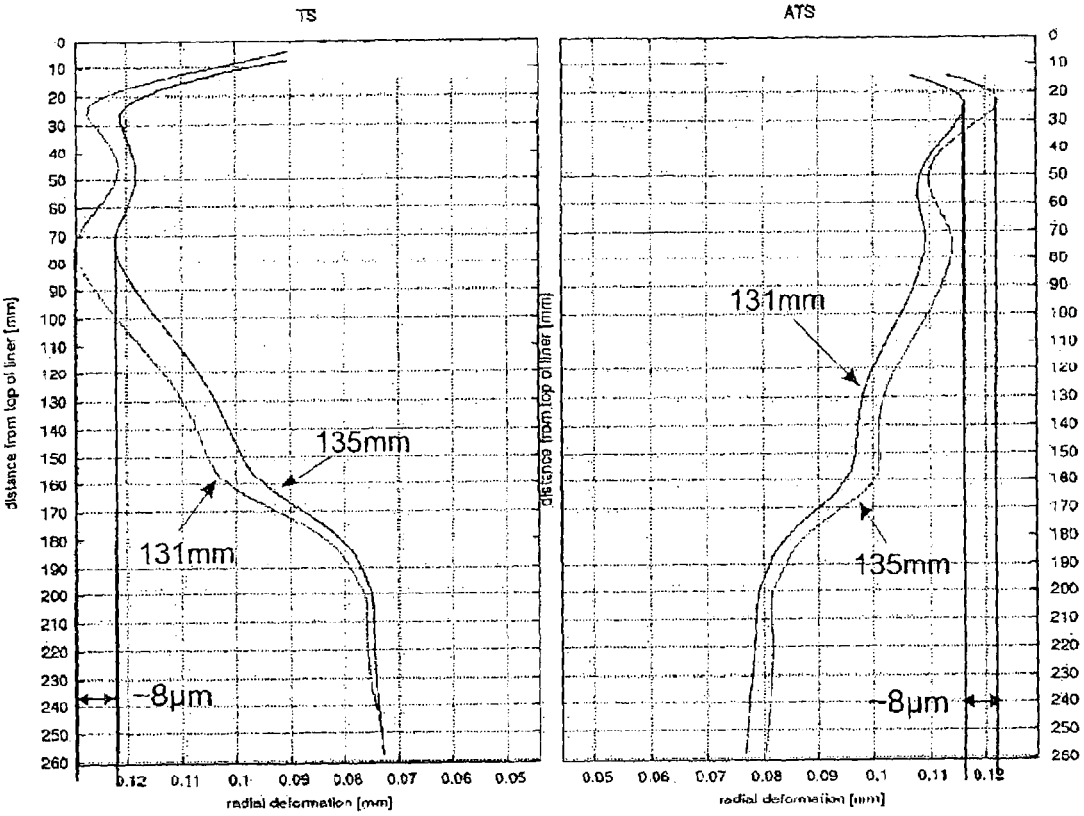
FIG. 3—is a chart that shows the deformation of the cast iron liner of this invention (outer lines) related to that of the iron liner of the state of the art (inner lines)

As it can be seen in FIG. 3, test results have demonstrated that the cylinder liner of the present invention shows a deformation of approximately 8 microns more than liners of the state of the art (pearlitic cast iron) in the upper cylinder region when exposed to peak cylinder pressure conditions of 200 to 240 bar in a 12.8 L diesel motor engine.

The external lines of FIG. 3 represent the deformation measurements of a 135 mm diameter ductile cylinder liner of the present invention exposed to cylinder in over pressure conditions. The internal lines of FIG. 3 represent the deformation measurements of a 131 mm diameter cylinder liner of the present invention exposed to cylinder nominal pressure conditions. The cylinder liner of the state of the art made of gray cast iron also exposed to over pressure condition presents values out of the safe factor condition with same 131 mm diameter. The results of these tests demonstrate that the cylinder liner can handle significantly greater cylinder pressure conditions and can afford acceptable and appreciable deformation than the deformation afforded by a cylinder liner of the state of the art made of gray cast iron. More specifically, this data points out that the cylinder liner of the present invention can accommodate a deformation of an additional 8 microns over the cylinder liner of the state of the art when exposed to over 40 more bars of pressure even with less wall thickness (higher bore diameter)

The data presented in FIG. 3 demonstrates that the material of the present invention may reduce the weight of the engine just by the thinning out of the inner wall thickness due to the alloy of the present invention having excellent fatigue resistance, strength and elasticity. The reduction in the weight of the engine as evidenced in these figures translates into potentially a 6 to 12 kgs in total weight reduction in a 6 cylinder diesel engine (1 to 2 kg weight reduction per cylinder).

The reduction in weight of the engine results in an improved engine with potentially more power afforded to it due to the decrease in engine weight. By decreasing the Heat Transfer Coefficient of the liner, the engine will operate at higher temperatures, combined with coolant liquids in the cooling channels kept at a higher temperature, can provide gains in thermal efficiency in the chamber to decrease the fuel injection necessary for combustion and, thus, reduce actual consumption. Hence, therefore, this reduction in weight shall result in better output for the engine and, consequently, lower emission of pollutants. It is also important to note that the possibility of reducing the liner thickness has huge advantages in assemblies of dry liner and power gain without changing the block's original design.

Thus, it is possible to settle a project of a cylinder liner depending on the result one wishes to obtain. On one hand, liner thickness may be kept, which will significantly increase the engine's life cycle or, on the other hand, thickness can be reduced in order to improve the engine's power and performance.

Additionally, it is important to note that the greater stiffness of the cylinder liner of this invention allows for increasing cavitation resistance in the outer diameter of the component.

Please note that such alloy can also be applied to the manufacturing of piston rings or components of the camshaft.

It shall also be mentioned that, due to the huge improvement provided by the alloy and by the liner of this invention, it is clear that although with a higher cost, the positive relation of the cost in view of performance proves to be commercially very interesting for engines that require high resistance of the components.

After describing examples of preferred embodiments, it shall be understood that the scope of the present invention encompasses other possible variations, being limited only by the contents of the attached claims, where the possible equivalents are included.

The invention claimed is:

1. A Cylinder liner for an internal combustion engine, comprising:

a cast iron alloy having a pearlitic structure with at least 70% of graphitization with spheroidal graphite morphology, the cast iron alloy including:

at least 2.8% to 4.0% in weight of carbon; 1.8% to 3.5% in weight of silicon; 0.2% to 1.0% in weight of manganese; a maximum of 0.5% in weight of phosphorus; a maximum of 0.05% in weight of sulfur; a maximum of 0.5% in weight of vanadium; a maximum of 0.5% in weight of molybdenum; 0.2% to 1.5% in weight of nickel; a maximum of 0.3% in weight of tin; 0.005% to 0.06% in weight of magnesium;

at least one of the elements copper, cobalt, titanium, niobium, boron, aluminum, molybdenum, zirconium, nitrogen, antimony, arsenic and bismuth in a total of up to 7.0% of the total weight of the alloy, and iron as remainder;

an inner diameter having an induction hardening thermal treatment and a hardness between 300 HV to 835 HV; and an elasticity modulus of at least 130 GPa;

wherein the inner diameter includes up to 1.5 mm of a martensitic structure throughout an extent of the inner diameter.

2. The cylinder liner according to claim 1, wherein the cast iron alloy includes up to 15% in weight of ferrite.

3. The cylinder liner according to claim 1, wherein the cast iron alloy includes a tensile strength higher than 500 Megapascal (MPa).

4. The cylinder liner according to claim 1, wherein the cast iron alloy includes a fatigue strength greater than 230 Megapascal (MPa).

5. The cylinder liner according to claim 1, further comprising a reduced wall thickness.

6. The cylinder liner according to claim 5, wherein the wall thickness is reduced between 3 and 35 percent as compared to a wall thickness of approximately 9.5 mm.

7. The cylinder liner according to claim 3, wherein the cast iron alloy includes a fatigue strength greater than 230 Megapascal (MPa).

8. The cylinder liner accord to claim 1, wherein the pearlitic structure includes at least 99% of spheroidal graphitization.

9. A cast iron alloy for a cylinder liner, comprising:

a pearlitic structure with at least 70% of graphitization with spheroidal graphite morphology;

at least 2.8% to 4.0% in weight of carbon; 1.8% to 3.5% in weight of silicon; 0.2% to 1.0% in weight of manganese; a maximum of 0.5% in weight of phosphorus; a maximum of 0.05% in weight of sulfur; a maximum of 0.5% in weight of vanadium; a maximum of 0.5% in weight of molybdenum; 0.2% to 1.5% in weight of nickel; a maximum of 0.3% in weight of tin; 0.005% to 0.06% in weight of magnesium;

at least one of the elements copper, cobalt, titanium, niobium, boron, aluminum, molybdenum, zirconium, nitrogen, antimony, arsenic and bismuth in a total of up to 7.0% of total weight, and iron as the remainder;

an inner diameter having an induction hardening thermal treatment and a hardness between 300 HV to 835 HV, wherein the inner diameter includes up to 1.5 mm of a martensitic structure throughout an extent of the inner diameter; and an elasticity modulus of at least 130 GPa.

10. The cast iron alloy according to claim 9, further comprising up to 15% in weight of ferrite.

11. The cast iron alloy according to claim 9, further comprising a tensile strength higher than 500 Megapascal (MPa).

12. The cast iron alloy according to claim 9, further comprising a fatigue strength greater than 230 MPa.

13. The cast iron alloy according to claim 9, further comprising a reduced wall thickness.

14. The cast iron alloy according to claim 13, wherein the wall thickness is reduced between 3 and 35 percent as compared to a wall thickness of approximately 9.5 mm.

15. The cast iron alloy according to claim 9, wherein the pearlitic structure includes at least 99% of spheroidal graphitization.

16. The cast iron alloy according to claim 11, further comprising a fatigue strength greater than 230 MPa.

* * * * *